United States Patent [19]

Kamon et al.

[11] Patent Number: 4,981,194

[45] Date of Patent: Jan. 1, 1991

[54] ELECTRO-ACOUSTIC TRANSDUCER

[75] Inventors: Yoshiyuki Kamon; Masahiko Iso, both of Kanagawa; Makoto Yamagishi, Tokyo, all of Japan

[73] Assignee: Sony Corporation, Tokyo, Japan

[21] Appl. No.: 259,513

[22] Filed: Oct. 18, 1988

[30] Foreign Application Priority Data

Oct. 30, 1987 [JP] Japan ..... 62-275431
Oct. 30, 1987 [JP] Japan ..... 62-275432

[51] Int. Cl.[5] ..... H04R 25/00

[52] U.S. Cl. ..... 181/129; 181/130; 181/135; 181/158; 381/187

[58] Field of Search ..... 181/129, 130, 135, 158; 387/183, 187

[56] References Cited

U.S. PATENT DOCUMENTS 4,403,120 9/1983 Yoshimi ..... 181/130 X
4,742,887 5/1988 Yamagishi ..... 181/129

FOREIGN PATENT DOCUMENTS 0023299 1/1987 Japan ..... 181/137

*Primary Examiner*—Benjamin R. Fuller
*Attorney, Agent, or Firm*—Lewis H. Eslinger; Jay H. Maioli

[57] ABSTRACT

An electro-acoustic transducer includes a housing enclosing an electro-acoustic transducer device and having an opening by which the diaphragm side of the transducer device is exposed to the outside, and a ring provided to the outer surface of the perimeter of the opening. The outer perimeter of the ring is adapted to be softer and more pliable than the housing.

12 Claims, 8 Drawing Sheets

ELECTRO-ACOUSTIC TRANSDUCER

BACKGROUND OF THE INVENTION

1. Field of the Invention

This invention relates to an electro-acoustic transducer advantageously applied to a small-sized earphone unit, headphone unit or a small-sized microphone unit.

2. Description of the Prior Art

As the electro-acoustic transducer of the type in which a housing enclosing an electro-acoustic transducer device is inserted into and attached within the ear's concha, when the transducer is in use, there is proposed in the art a so-called inner ear type headphone unit.

Such headphone apparatus is shown in FIG. 1 and includes a housing 102 enclosing a speaker unit which is the electro-acoustic device. This housing 102 is formed with a size such that it can be introduced into the ear's concha and has an open sound-radiating surface of the speaker unit 101. A connecting cord 103 supplying acoustic signals to the speaker unit 101 has its ends 104 connected as by soldering to input terminals 105 of the speaker unit 101. The connecting cord 103 is fed out of the housing 102 to the outside by way of a cord extraction opening 106.

An ear pad ring 107 is provided on the portion of the housing 102 facing to the ear's concha and on the perimeter of the front side of the speaker unit 101. This ear pad ring 107 is engaged with a rib 102*a* provided on the perimeter of the open portion of the housing 102, and is attached to this portion by auxiliary securing means, such as adhesive.

The housing 102 is formed of a relative hard material in consideration that it has to hold the speaker unit 101 in position and for providing certain acoustic effects. On the other hand, the ear pad ring 107 is formed of a relatively soft material for providing good contact feel with the inner wall of the ear's concha and insertion of the ring into the ear's conchae of different sizes.

In order that the portion of the connection cord 103 extracted through the extraction opening 106 may be protected from accidents such as cord breakage caused by repeated cord flexure, a cylindrical cord strain-relief bushing 108 is provided on the housing 102 extending from the cord extraction opening 106. The cord bushing 108 is formed of a relatively soft material, similar to the ear pad ring 107, and is provided with peripheral slots 109 to allow the bushing 108 to flex easily. The portion of the connection cord 103 extracted through the cord extraction opening 106 may be bent smoothly as it is encased within the cord bushing 108 when a stress is applied from outside to prevent breakage of the cord at the edge of the cord extraction opening 106.

In the operation of the above described headphone unit, when the housing 102 is introduced into the ear's concha, the ear pad ring 107 is deformed under a pressure applied from the inner wall of the ear's concha. The ear pad ring 107 is adapted to close the ear's concha completely by abutting on the inner wall of the ear's concha by its own resiliency. With the ear's concha thus closed completely, the sound may be reproduced by the speaker unit 101 with optimum electro-acoustic characteristics.

In will be noted that, since the size of the ear's conchae will differ from one person to another, it may occur that the above described headphone unit cannot be introduced into the ear's concha, or the ear's concha cannot be closed satisfactorily by the ear pad ring 107, with the result that optimum acoustic characteristics are not obtained.

That is, with the outside diameter $d_1$ of the ear pad ring 107, the ear pad ring cannot be deformed to an outside diameter $d_0$ of the rib 102*a*. Therefore, when the ear's concha has an inside diameter less than the outside diameter $d_0$ of the rib 102*a*, the housing 102 cannot be introduced into the ear's concha. On the other hand, when an ear's concha has the inside diameter larger than the outside diameter of the ear pad ring 107, a void or gap is formed between the ear pad ring 107 and the inner wall of the ear's concha, so that the ear's concha is not closed completely.

When the ear's concha is not closed completely in this manner, the output is lowered especially in the lower frequency range of the acoustic characteristics, as shown at C in FIG. 9, with result that optimum electro-acoustic characteristics cannot be realized.

It is noted that the acoustic characteristics shown at B in FIG. 9 are those obtained when the ear's concha is closed as normally in the above described conventional headphone unit.

For maintaining the optimum acoustic characteristics as described above, it is necessary that the ear pad ring 107 be formed of a softer material and with an increased thickness as that it may be deformed radially more easily and with a larger amount of deformation. However, when the housing 102 is mounted to or detached from the ear's concha, a stress is applied to the ear pad ring 107 tending to displace the ear pad ring 107 away from the housing 102 in the direction shown by arrow F FIG. 1 under the force of friction with the inner wall of the ear's concha. When the ear pad ring 107 is formed of a soft and pliable material, the ear pad ring is deformed easily under such stress. When the ear pad ring 107 is deformed under the stress in this manner, both the aforementioned engaging and auxiliary securing means tend to be loosened so that the ear pad ring may be readily detached from the rib 102*a*.

In short, when the material of the ear pad ring is formed of a softer material, the size range of the ear's conchae into which a given ear pad ring can be introduced is enhanced, while the contact feel of the apparatus with the ear's concha is improved. However, when the ear pad ring is formed of a softer material, the ear pad ring is more likely to be detached from the housing, so that of the earphone unit durability is not assured. For this reason, the desired durability may only be assured at the sacrifice to some extent of the aforementioned acoustic characteristics and the use or contact feel.

The same inconvenience as felt with the ear pad ring arises with the cord bushing 108. That is, when the cord bushing is formed of a softer material, the connection cord 103 may be protected more reliably, however, the cord is more likely to be detached from the housing 102.

In our copending Japanese Laid-open Patent Publication No. 23299/1987, there is proposed an electro-acoustic transducer in which the housing enclosing the speaker unit, ear pad ring and the cord bush are molded integrally from the same material for facilitating the assembling operation and improving the durability. However, in this electro-acoustic transducer, since the portion contacting the ear's concha and the housing adapted to hold the speaker unit are formed of the same material, the material suitable for both the contacting portion and the housing cannot be used, such that the contacting portion and the housing need be formed of a material having only moderate hardness.

OBJECT AND SUMMARY OF THE INVENTION

It is therefore an object of the present invention to provide an electro-acoustic transducer free from the deficiencies of the prior-art headphone unit.

It is another object of the present invention to provide an electro-acoustic transducer wherein good use feel, positive protection of the connection cords and sufficient durability may be achieved.

It is a further object of the present invention to provided an electro-acoustic transducer, such as a headphone unit, wherein the ear pad ring or the cord bush are not detached from the housing after repeated use of the transducer.

The above and other objects of the present invention will become apparent from the following description especially when read in conjunction with the accompanying drawings.

In accordance with the present invention, there is provided an electro-acoustic transducer comprising a housing enclosing an electro-acoustic transducer device, said housing including an opening by which the diaphragm side of the electro-acoustic transducer device is exposed to the outside, and a ring provided to the outer surface of the perimeter of said opening and having its outer periphery softer than said housing.

In the electro-acoustic transducer of the present invention, at least the outer surface portion of the housing around the opening by which the sound radiating side or sound input side of the electro-acoustic transducer unit is exposed to the outside is formed of a material other than the material of the remaining portion of the housing, so that these portions are formed of separate materials different in color and/or material, these materials being strongly bonded to each other.

DESCRIPTION OF THE PREFERRED EMBODIMENT

Figure 1:
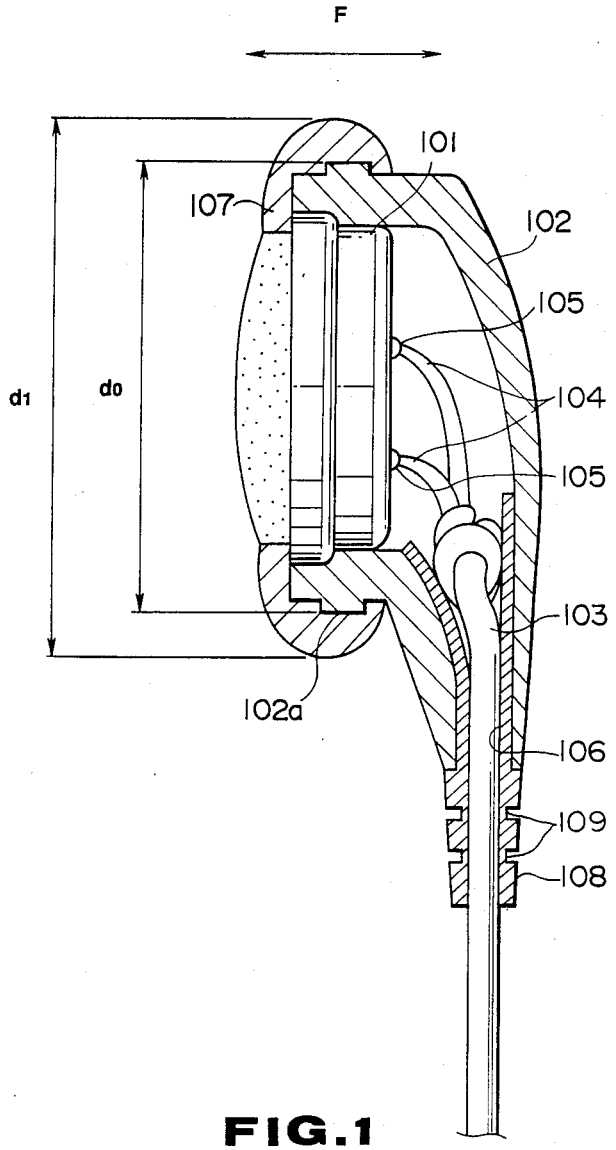
FIG.1 PRIOR ART
FIG. 1 is a sectional view showing the construction of the conventional headphone unit.

A first embodiment of the present invention in which it is applied to a headphone apparatus attached to and used in the ear's concha similarly to the above described conventional system, is explained by referring to the drawings.

Figure 2:
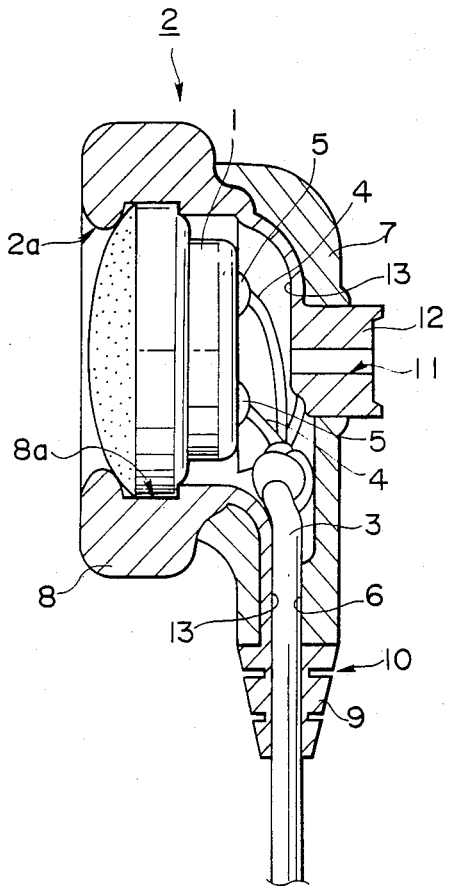
FIG. 2 is a sectional view showing the construction of the headphone unit according to a first embodiment of the present invention.

The headphone unit according to the first embodiment of the present invention as shown in FIG. 2 and includes a housing 2 enclosing a speaker unit 1 as the electro-acoustic device.

This speaker unit 1 is provided with a magnetic circuit including a magnet and a yoke, a coil bobbin driven by the magnetic circuit, and a diaphragm attached to this coil bobbin. The electric signals supplied to the coil bobbin are converted into sounds by the vibration of the diaphragm in well-known manner.

The housing 2 is of a size such that it can be introduced into the ear's concha, and is provided with an opening 2*a* so that the sound radiating side of the speaker unit 1 is facing to the outside at the opening 2*a*. A connecting cord 3 adapted to supply the electrical signals to the speaker unit 1 has its leads 4 connected as by soldering to an input terminals 5 of the speaker unit 1. The connecting cord 3 is fed out of the housing 2 to the outside by way of the cord extraction opening 6.

Figure 3:
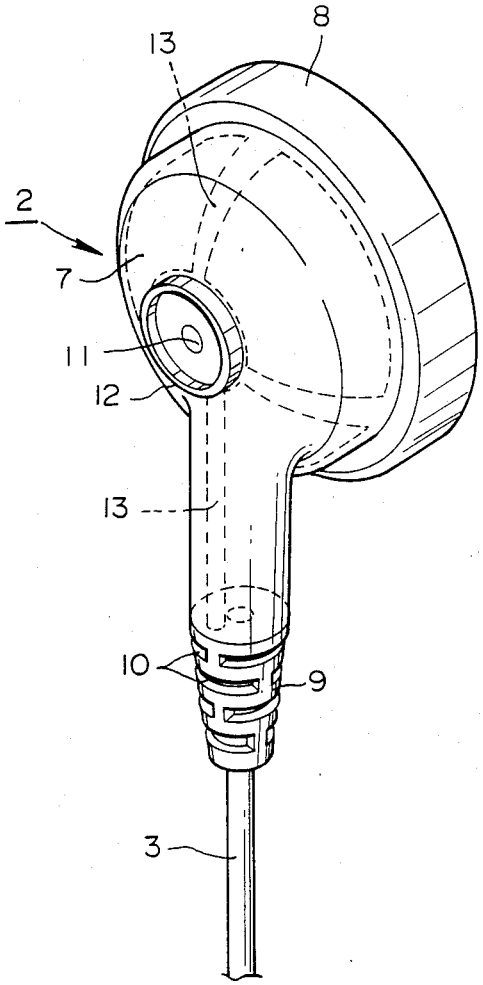
FIG. 3 is a perspective view showing the headphone unit of the first embodiment.

The housing 2 is shown in FIGS. 2 and 3 and includes a main body 7 covering the rear side of the speaker unit 1, an ear pad 8 formed around the opening 2*a* and a cord bushing 9 extending out of the cord lead-out opening 6.

Since it is necessary to hold the shape of the housing 2 in its entirety and to provide good acoustic effects, the main body 7 is formed of a relatively stiff material having the rubber hardness of the order of 90 degrees, such as ABS resin.

The ear pad 8 is formed on that portion of the perimeter of the opening 2*a* of the housing 2 that contacts the inner wall of the ear's concha by what is called a double-shot molding.

By "double-shot molding" is meant a method of double injection molding including the steps of forming a portion of a first material using a first metal mold, placing the portion of the first material in a predetermined position of a second metal mold and injecting and molding a second material in the second metal mold to form a molded article composed of the first and the second materials rigidly connected and united to each other. When a two-color injection molding machine is employed, after the portion of the first material is molded, the predetermined movable portion of the metal mold may be shifted and the second material injected and molded to form a molded article formed of two kinds of materials.

For providing a soft feel on contact of the ear pad 8 with the inner wall of the ear's concha, and for making it possible to introduce the ear pad 8 into the ear's conchae of different sizes, the ear pad 8 is formed of a relatively soft and pliable material having a rubber hardness of about 60 degrees, such as urethane, or an elastomeric material having a still lower rubber hardness. The material of the ear pad 8 is of a different color from the material of the main body 7. The inner side of the ear pad 8 is formed with a slot 8*a* for holding the speaker unit 1. The speaker unit 1 is held in position with its peripheral portion received within the slot 8*a*.

The cord bushing 9 is adapted for protecting the portion of the connecting cord 3 that is fed out by way of the cord extraction opening 6 from breakage caused by repeated flexure, and is formed with a cylindrical shape on the line of extension of the cord extraction opening 6. The cord bushing 9 is formed by the double-shot molding from the same material as that of the ear pad 8. A plurality of annular slots 10 are formed on the outer peripheral surface of the cord bushing 9 to permit the cord bushing 9 to be flexed readily. The portion of the connecting cord 3 that is extracted through the cord extraction opening 6 is supported by the cord bushing 9 so that it may be bent smoothly as it is sheathed in the cord bushing 9 on application of an external force to prevent incidental breakage otherwise caused by flexure of the connecting cord in contact with the edge of the cord extraction opening 6.

A through-hole 11 is formed at the portion of main body 7 facing to the rear surface of the speaker unit 1. The through-hole 11 is provided for improving acoustic effects. The through-hole 11 is surrounded by a through-hole frame 12. By providing the through-hole 11 on the rear side of the main body 7, optimum frequency response characteristics may be produced up to the low frequency range of the frequency response curve even for a small-sized speaker unit. The through-hole 11 and the frame 12 thus make up an acoustic pipe or reflex port adapted for compensating the decrease in response in the low frequency range of the frequency response curve. The frame 12 is provided mainly for decoration purposes and is formed of the same material as the ear pad 8 and the cord bushing 9 by the double-shot molding.

The ear pad 8, cord bushing 9 and the frame 12 are formed simultaneously from the same material and are connected with one another by runners 13. These runners or ribs are formed for extending along the inner surface of the main body 7.

According to the above described first embodiment of the present invention, the molding of the housing 2 in its entirety and optimum acoustic properties are assured by the main body 7, while the soft feel of the portion of the unit contacting with the ear's concha is assured by the ear pad 8 and the cord bushing 9. The main body 7, ear pad 8 and the cord bushing 9 are formed by double-shot molding of two different kinds of material that are firmly bonded together by virtue of double-shot molding and are unlikely to be peeled off from each other after repeated or prolonged usages.

Although the housing of the electro-acoustic transducer in the first embodiment of the present invention is formed of two kinds of materials that are different in hardness and color, it may also be formed of two kinds of materials different only in color or in hardness by the double-shot material molding.

Figure 4:
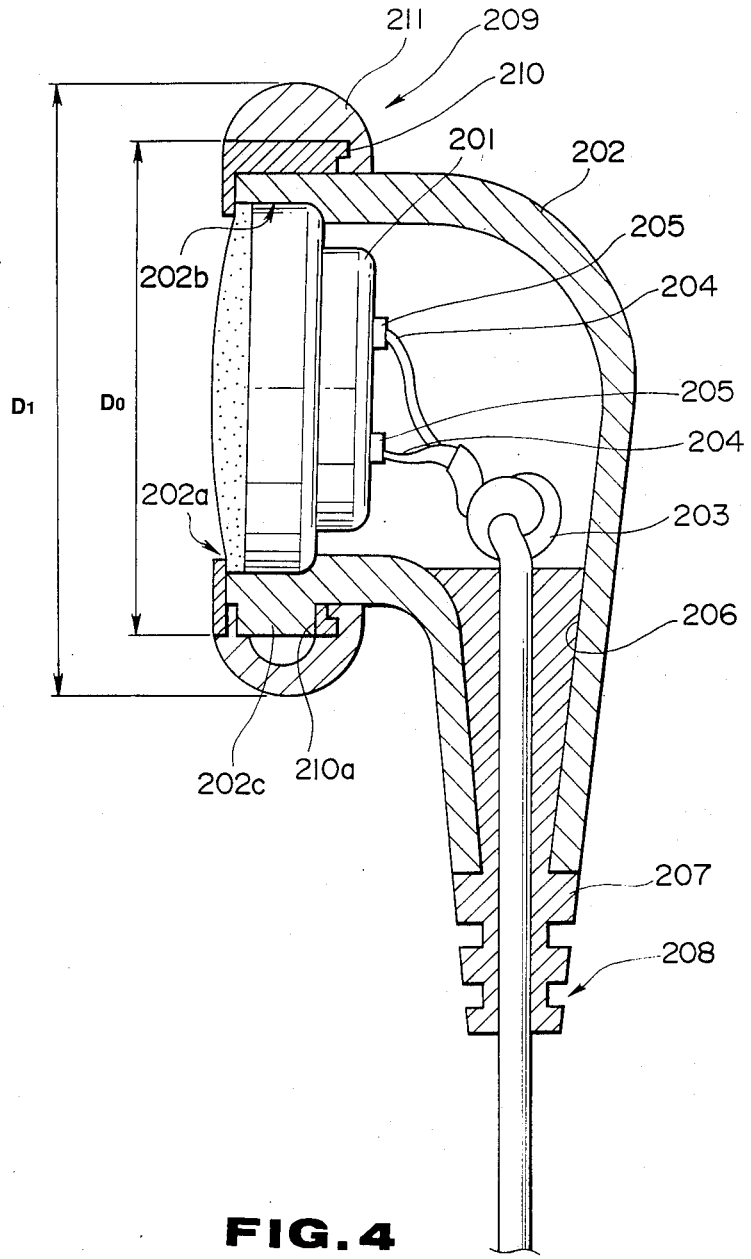
FIG. 4 is a sectional view showing the construction of the headphone unit according to the second embodiment.

A second embodiment of the present invention will be explained by referring to the drawings. FIG. 4 shows a housing 202 and an electro-acoustic transducer or speaker unit 201 enclosed in the housing 202.

The speaker unit 201 includes a magnetic circuit composed of a magnet and a yoke, a coil bobbin driven by the magnetic circuit and a diaphragm attached to the coil bobbin. The electrical signals supplied to the coil bobbin are converted into sounds or voice by the vibrations of the diaphragm, in a well-known manner.

The housing 202 is of a size such that it can be introduced into the ear's concha. The side of the housing 202 corresponding to the sound radiating side of the speaker unit 201 is formed with an opening 202*a*. For holding the speaker unit 201 in position, and for providing acoustic effects, the housing 202 is formed of a relatively stiff material having a rubber hardness of about 90 degrees, such as ABS resin. The speaker unit 201 is held in position with its peripheral portion fitted in a mating recess 202*b* formed on the inner wall of the opening 202*a*. A connecting cord 203 supplying electric signals to the speaker unit 201 has its terminal portions 204 connected as by soldering to an input terminals 205 of the speaker unit 201. The connecting cord 203 is also fed out of the housing 202 through a cord extraction opening 206.

For protecting the portion of the connecting cord 203 extracted through the cord extraction opening 206 from accidents such as cord breakage caused by repeated cord flexure, a cylindrical cord bushing 207 is provided on a line of extension of the cord extraction opening 206, as in the aforementioned conventional headphone unit. The cord bushing 207 is formed of a relatively soft and pliable material and moreover has a plurality of annular slots 208 as shown, so that it may be flexed easily. The portion of the connecting cord 203 extracted out of the cord extraction opening 206 is supported by the cord bushing 207 so that it may be flexed smoothly as it is encased in the cord bushing 207 when an external force is applied thereto. In this manner, the risk of accidents such as the cord breakage otherwise caused by the flexure of the cord in contact with the edge of the cord extraction opening 206 may be minimized.

Figure 5:
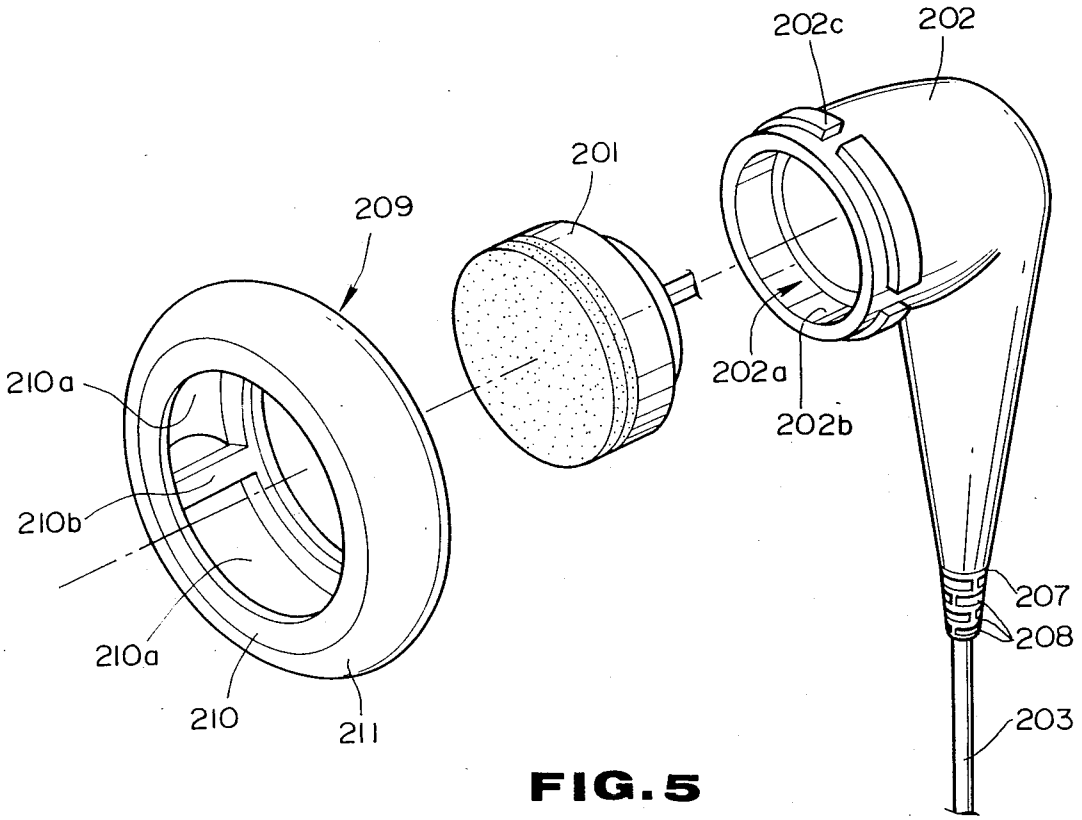
FIG. 5 is an exploded perspective view showing the construction of the headphone unit according to the second embodiment.
Figure 7:
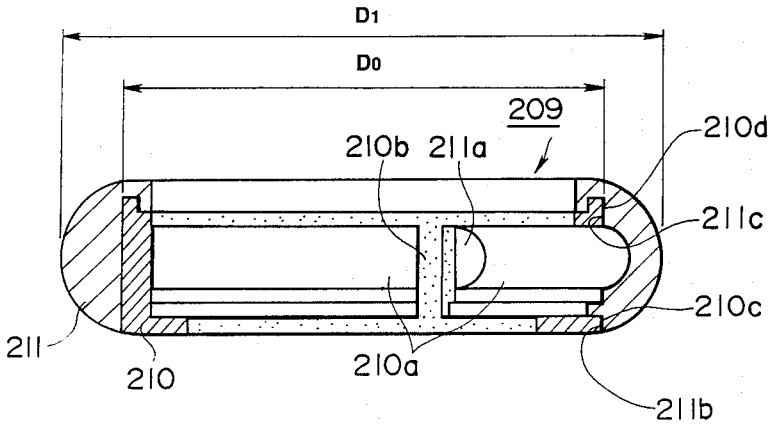
FIG. 7 is a sectional view showing the base ring portion and the elastic ring shown in FIG. 6.
Figure 8:
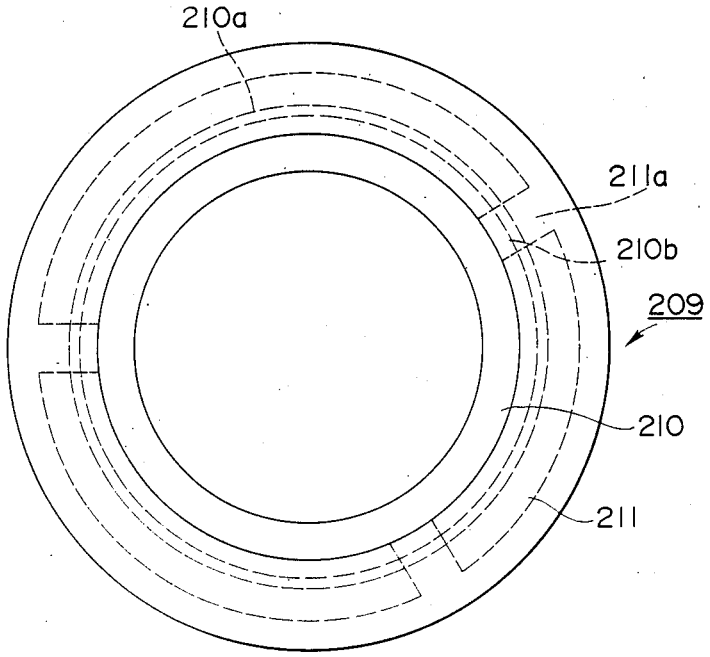
FIG. 8 is a plan view of FIG. 7.

The housing 202 is fitted, as shown in FIGS. 4 and 5, with a ring member 209 on the perimeter of the opening 202*a*. This ring member 209 is formed by a base ring 210 and an elastic ring 211 provided on the perimeter of the base ring 210, as shown in FIGS. 7 and 8. These rings 210, 211 are formed by double-shot molding from respective different materials.

Figure 6:
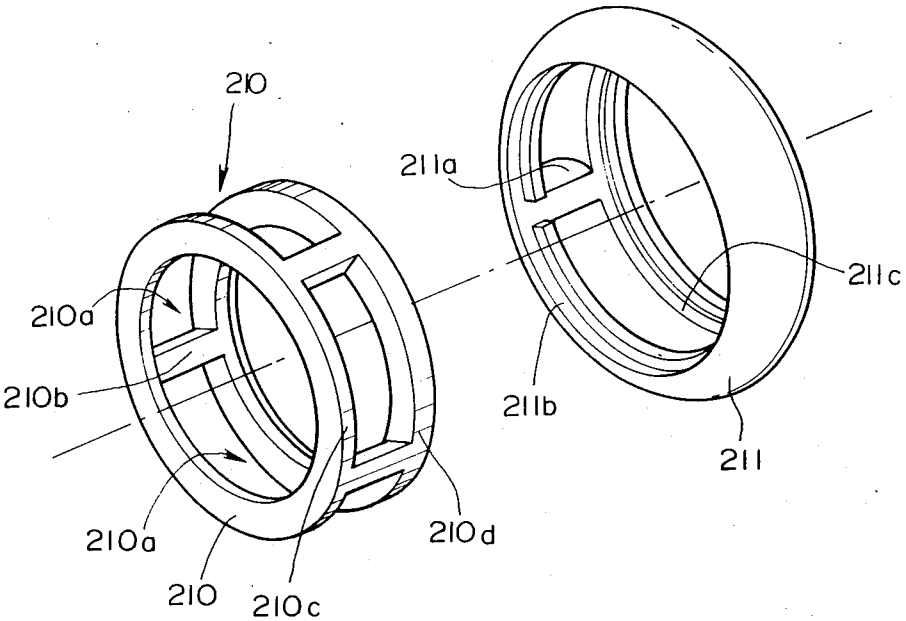
FIG. 6 is an exploded perspective view showing the base ring portion and the elastic ring portion employed in the second embodiment.

The base ring 210 is formed of the same material as the housing 202, and with a toroidal profile with an outside diameter $D_0$ as shown in FIGS. 4 and 7. The toroidal or ring-shaped peripheral wall of the base ring 210 is formed with plural circumferentially extending recesses 210*a*, as shown in FIG. 5, for engaging with mating projections 202*c* provided on the outer wall of the housing 202 about the opening 202*a*. The spacing between two neighboring recesses 210*a* is formed as a rib 210*b*. The base ring 210 is fitted to the housing 202 in a position with the projections 202C being fitted to the recesses 210*a*. The elastic ring 211 is formed of a material having a rubber hardness of, for example, 60 degrees, or of a softer material, such as so-called elastomer, having a rubber hardness of 20 to 40 degrees, and is molded on the outer perimeter of the base ring 210 by the above described double-shot molding. The ring 211 has a prescribed outside diameter shown at $D_1$ in FIG. 4. The portion of the elastic ring 211 receiving the base ring 210 is recessed to accommodate the base ring 210, while the portions of the ring 211 corresponding to the ribs 210*b* are formed with tongue-like supporting portions 211*a*. The elastic ring 211 has its one and other peripheral edge surfaces 211*b*, 211*c* and the supporting portions 211*a* operatively associated with the peripheral edge surfaces and 210*c*, 210*d* and the ribs 210*b* of the base ring 210, as best shown in FIG. 6.

It the above described headphone unit, the outside diameter of the elastic ring 211 shown at $D_1$ in FIG. 4 is selected to be sufficiently larger than the size of the largest possible ear's concha of the users, while the outside diameter of the base ring 210 shown at $D_0$ in FIG. 4 is selected to be sufficiently smaller than the size of the smallest possible ear's concha of the users.

When the housing 202 is introduced into the ear's concha, since the elastic ring 211 is formed of a material of low hardness and is recessed, it can be easily deformed from the outside diameter in the undeformed state of the elastic ring 211 to the outside diameter approximately equal to the outside diameter of the base ring 210. In this manner, the sealing properties of the housing 202 with respect to the ear's concha when the housing is inserted into the ear's concha are improved, so that satisfactory acoustic properties are obtained in which, as shown at A in FIG. 9, the output in the low frequency range is improved as compared to that of the above described conventional headphone unit.

The soft contact feel of the portion of the housing 202 contacting with the ear's concha may also be achieved. The base ring 210 and the elastic ring 211 are formed by the double-shot molding so that the materials of the rings 210, 211 are strongly bonded together without the risk of peeling after repeated usage or application.

Figure 9:
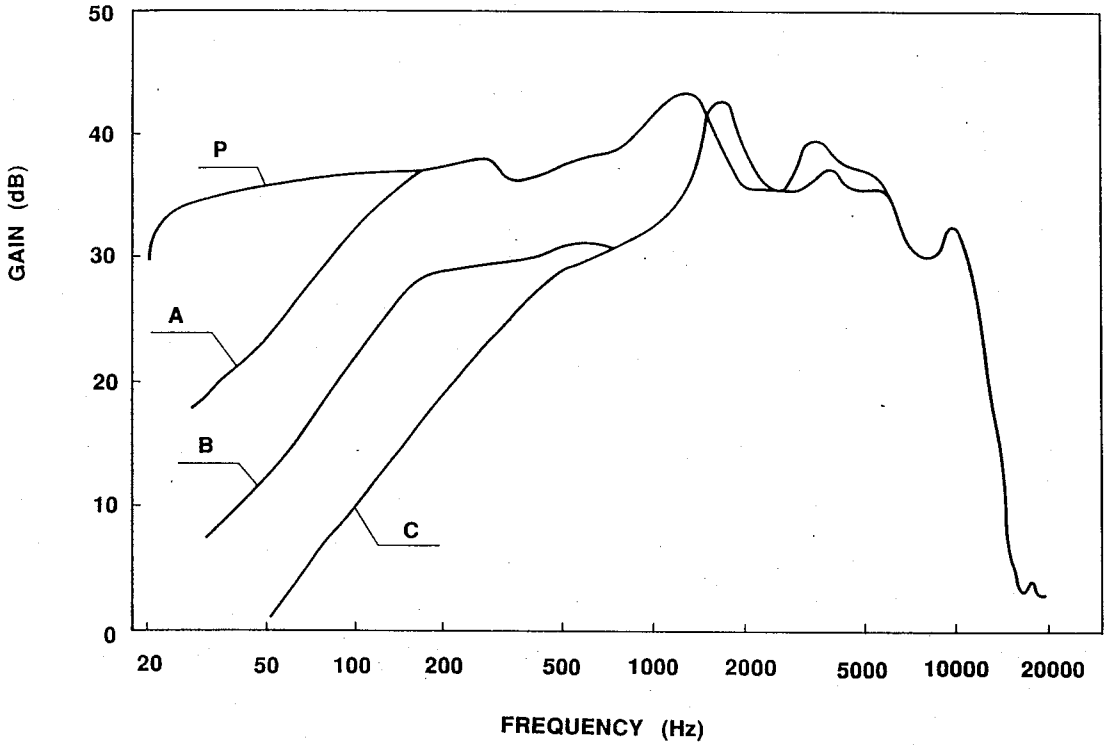
FIG. 9 is a diagram showing acoustic characteristics of the headphone unit of the second embodiment of the present invention and those of the conventional headphone unit.

It is noted that the acoustic characteristics shown at P in FIG. 9 represent those in the ideal complete sealing state of the housing with respect to the ear's concha.

It is noted that the electro-acoustic transducer of the present invention is not limited to the above described headphone unit, but may also be applied to other earphone or microphone units.

For example, when a microphone unit is constructed in accordance with the present invention and the rings are provided to the outer side of the opening of the housing exposing the sound input side of the electro-acoustic transducer unit, the effect of the noises generated by contact of the user's hands or fingers etc. with the housing on the electro-acoustic transducer unit may be minimized. Also, since the base ring and the elastic ring are attached to the manually gripped portion of the housing, the housing may be gripped more comfortably.

According to the first embodiment of the electro-acoustic transducer of the present invention, as described hereinabove, the outer surface of the opening of the housing by which at least the diaphragm of the electro-acoustic transducer is exposed to the outside, is formed of a material different from the material of the remaining portion.

Hence, the portion of the housing that is formed by double-shot molding is formed of materials different in color and/or hardness and that are united strongly to each other.

Therefore, when the so-called inner ear type headphone unit is constituted in accordance with the present invention, the portion of the housing contacting with the inner wall of the ear's concha is formed of a soft and pliable material to provide a soft contact feel with the ear's concha, while the main body of the housing is formed of a relatively stiff material to provide optimum acoustic characteristics and reliable holding of the speaker unit. In addition, the two materials of different hardness are connected rigidly to each other for assuring durability of the headphone unit.

The number of component parts is also reduced and the assembling operation is simplified since the operation can be achieved by simply fitting the electro-acoustic transducer unit, such as the speaker unit, into the housing formed by double-shot molding.

In addition, according to the second embodiment of the present invention, a base ring is provided on the outer surface of the perimeter of the opening of the housing, by which the sound radiating side or the sound input side of the electro-acoustic transducer is exposed to the outside, and an elastic ring is provided on the outer periphery of the base ring that is formed of an elastic material by double-shot molding. The elastic ring is subject to considerable deformation and the two materials constituting the elastic ring are united together strongly by the double-shot molding.

Therefore, when the so-called inner ear type headphone unit is designed and constructed in accordance with the present invention, satisfactory contact feel and optimum acoustic characteristics may be maintained even when the unit is attached to the ear's conchae of different size. In addition, the two materials of different hardness may be formed together strongly for assuring improved durability of the headphone unit.

What is claimed is:

1. An electro-acoustic transducer assembly for use in the concha of a human ear, the assembly comprising:

a housing formed of synthetic resin and being of a size to be received in a recess of the concha and enclosing an electro-acoustic transducer device, said housing including an opening by which a diaphragm side of the electro-acoustic transducer device is exposed; and a double-shot molded ring formed with said housing and having a first portion arranged on an outer surface of a perimeter of said opening and a second portion extending into said opening and around the electro-acoustic transducer device, said ring being formed of a material that is softer and more pliable than a material forming said housing.

2. The electro-acoustic transducer according to claim 1 wherein said portion of said ring extending into said opening of said housing extends around a back side of the transducer device and includes an integrally formed compensating means for compensating a low frequency portion of the frequency response of the transducer device.

3. The electro-acoustic transducer according to claim 2 wherein said compensating means is formed by an acoustic tube.

4. The electro-acoustic transducer according to claim 2 wherein said compensating means is a frame having a throughhole.

5. The electro-acoustic transducer according to claim 2 wherein said ring is formed integrally with a cord bushing for holding an electrical cord connected to said electro-acoustic transducer device.

6. The electro-acoustic transducer according to claim 5, wherein said elastic ring portion is formed of a material having a lower rubber harness than a rubber hardness of the material forming said housing.

7. The electro-acoustic transducer according to claim 1 wherein said ring is formed of a synthetic resin material having a lower rubber hardness than a rubber hardness of the synthetic resin material forming said housing.

8. The electro-acoustic transducer according to claim 1 wherein said ring is formed of a material different in color from the material forming the housing.

9. The electro-acoustic transducer according to claim 1 wherein said ring is comprised of a base ring portion and an elastic ring portion.

10. The electro-acoustic transducer according to claim 9 wherein said base ring portion is formed to fit over an outer surface of the opening in said housing.

11. The electro-acoustic transducer according to claim 10 wherein said base ring portion is provided with a plurality of recesses mating with projections formed on the outer surface of said opening.

12. The electro-acoustic transducer according to claim 1, wherein said portion of said ring arranged on said outer surface of said housing is adapted to support said electro-acoustic transducer device.

* * * * *